US008742946B1

(12) United States Patent
Worthy et al.

(10) Patent No.: US 8,742,946 B1
(45) Date of Patent: Jun. 3, 2014

(54) SYSTEM AND RELATED METHODS FOR POWERING AND CONTROLLING TRAFFIC PREEMPTION SYSTEM COMPONENTS

(75) Inventors: David G. Worthy, Gilbert, AZ (US); Timothy A. Geiger, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 111 days.

(21) Appl. No.: 13/436,233

(22) Filed: Mar. 30, 2012

(51) Int. Cl.
*G08G 1/07* (2006.01)

(52) U.S. Cl.
USPC ..... 340/906; 340/301; 340/902; 340/903; 340/907; 340/425.5; 701/1; 701/117; 701/118; 701/119

(58) Field of Classification Search
USPC ..... 340/906, 301, 902, 903, 907, 425.5; 701/1, 117, 118, 119
See application file for complete search history.

(56) References Cited

U.S. PATENT DOCUMENTS 4,386,436 A * 5/1983 Kocher et al. ..... 455/151.4
5,955,968 A * 9/1999 Bentrott et al. ..... 340/906
6,064,319 A * 5/2000 Matta ..... 340/917
6,232,889 B1 * 5/2001 Apitz et al. ..... 340/906
6,909,380 B2 * 6/2005 Brooke ..... 340/906
7,113,108 B1 * 9/2006 Bachelder et al. ..... 340/906
7,620,812 B2 * 11/2009 Sikora et al. ..... 713/168
8,054,202 B1 * 11/2011 Sikora et al. ..... 340/906
8,171,290 B1 * 5/2012 Sikora et al. ..... 713/168
8,339,280 B1 * 12/2012 Sikora et al. ..... 340/906
8,373,578 B1 * 2/2013 Sikora et al. ..... 340/906
2004/0008127 A1 * 1/2004 Manavi et al. ..... 340/907
2005/0264431 A1 * 12/2005 Bachelder ..... 340/906
2006/0273925 A1 * 12/2006 Schwartz ..... 340/907
2006/0273926 A1 * 12/2006 Schwartz ..... 340/907
2007/0001872 A1 * 1/2007 Ellison ..... 340/907
2007/0008174 A1 * 1/2007 Schwartz ..... 340/902

* cited by examiner

*Primary Examiner* — Benjamin C Lee
*Assistant Examiner* — Quang D Pham
(74) *Attorney, Agent, or Firm* — Booth Udall Fuller, PLC

(57) ABSTRACT

A traffic preemption system comprising an intersection control module, an intersection preemption unit comprising a signal detector configured to receive a signal transmitted by a vehicle preemption unit mounted to a vehicle and a remotely located electronic device comprising a controller configured to detect a variation in voltage. The system further comprises a cable coupling the intersection controller, the intersection preemption unit, and the remotely located electronic device, the cable comprising a power wire configured to carry a modulated voltage level and share power among the intersection preemption unit and the remotely located electronic device, a ground wire, and a communications wire configured to transmit a communications signal between the intersection preemption unit and the intersection controller.

20 Claims, 4 Drawing Sheets

SYSTEM AND RELATED METHODS FOR POWERING AND CONTROLLING TRAFFIC PREEMPTION SYSTEM COMPONENTS

BACKGROUND

1. Technical Field

Aspects of this document relate generally to powering and controlling traffic preemption systems.

2. Background Art

At roadway traffic intersections, the amount of electronic equipment has grown substantially over the years. Besides the traffic lights themselves, it is common to see such equipment as all types of traffic measurement devices, cameras, communications equipment, pedestrian safety indicators and controls, emergency phones, and other emergency equipment such as traffic preemption systems, to name a few.

All of these systems require power and a method of communication to enable their operation. By far the most common way to accomplish this is to run wires from any such equipment to a traffic intersection control module that is commonly designed to provide environmental protection, power, communications, and secure access to equipment located inside.

It is very common to add such equipment to traffic intersections after the traffic light is already installed and this process usually requires running or installing additional wires for power and communication. The installation of wires at intersections can be time consuming and very costly, and in many cases is the largest cost of the system. Because of the high cost of labor and installation of additional wires, many improvements to traffic-related simply are not affordable for local municipalities to undertake.

Thus, a need exists for a system and method to limit or in some cases eliminate the necessity of installing an excessive number of wires and/or cables in both new and existing intersection locations.

SUMMARY

Implementations of a traffic preemption system may comprise an intersection control module, an intersection preemption unit comprising a signal detector configured to receive a signal transmitted by a vehicle preemption unit mounted to a vehicle, and a remotely located electronic device comprising a controller configured to detect a variation in voltage. The system may further comprise a cable coupling the intersection controller, the intersection preemption unit, and the remotely located electronic device, the cable comprising a power wire configured to carry a modulated voltage level and share power among the intersection preemption unit and the remotely located electronic device, a ground wire, and a communications wire configured to transmit a communications signal between the intersection preemption unit and the intersection controller.

Particular aspects may include one or more of the following features. The remotely located electronic device may comprise a confirmation light configured to indicate receipt of the signal by the signal detector of the intersection preemption unit. The system may further comprise a diode coupled in series with the power wire and a transistor located across the diode. The system may further comprise a microprocessor configured to create a digital control signal for transmission over the power wire. The confirmation light may further comprise a confirmation light controller that is further configured to engage or disengage the confirmation light in response to a digital control signal transmitted over the power wire. The remotely located electronic device may further comprise a microprocessor configured to process the digital control signal received via the power wire. The remotely located electronic device controller may further comprise a comparator circuit configured to compare a voltage on the power wire at different points in time. The communications wire may be further configured to convey a signal from the remotely located electronic device to the intersection control module. The signal may be conveyed from the remotely located electronic device to the intersection control module using handshaking. The communications wire may be further configured to convey a superimposed signal in addition to the communications signal transmitted between the intersection preemption unit and the intersection controller.

Implementations of a method of constructing a traffic preemption system may comprise providing an intersection control module, providing an intersection preemption unit comprising a signal detector configured to receive a signal transmitted by a vehicle preemption unit configured to mount to a vehicle, and remotely locating an electronic device comprising a controller configured to detect a variation in voltage. The method may further comprise coupling the intersection controller, the intersection preemption unit, and the remotely located electronic device with a cable comprising a power wire configured to carry a modulated voltage level and share power among the intersection preemption unit and the remotely located electronic device, a ground wire, and a communications wire configured to transmit a communications signal between the intersection preemption unit and the intersection controller.

Particular aspects may include one or more of the following features. The remotely located electronic device may comprise a confirmation light configured to indicate receipt of the signal by the signal detector of the intersection preemption unit. The method may further comprise coupling a diode in series with the power wire and locating a transistor located across the diode. The method may further comprise coupling a microprocessor to the power wire, the microprocessor configured to create a digital control signal for transmission over the power wire. The method may further comprise providing a confirmation light controller that is further configured to engage or disengage the confirmation light in response to a digital control signal transmitted over the power wire. The method may further comprise providing a microprocessor configured to process the digital control signal received by the remotely located electronic device via the power wire. The method may further comprise providing a comparator circuit coupled to the controller of the remotely located electronic device, the comparator circuit configured to compare a voltage on the power wire at different points in time. The communications wire may be further configured to convey a signal from the remotely located electronic device to the intersection control module. The remotely located electronic device and the intersection control module may be configured to communicate using handshaking. The communications wire may be further configured to convey a superimposed signal in addition to the communications signal transmitted between the intersection preemption unit and the intersection controller.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Description, Drawings, or Claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended traffic preemption system and/or assembly procedures for a traffic preemption system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such traffic preemption systems and implementing components, consistent with the intended operation.

Figure 1:
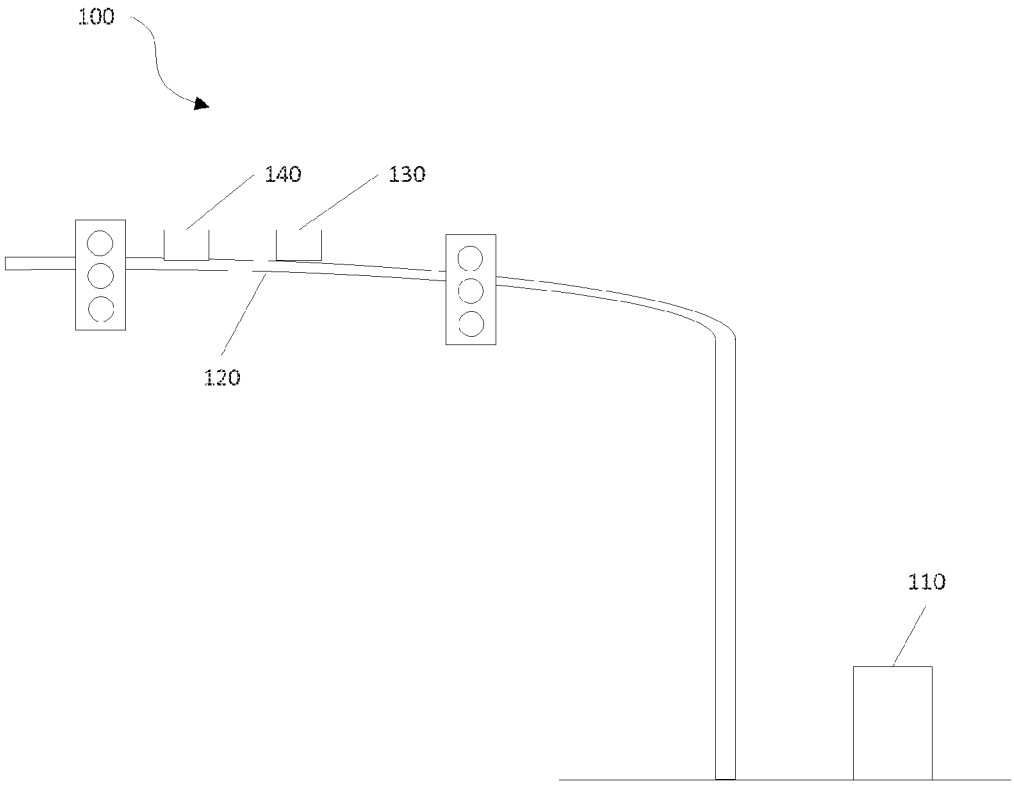
FIG. 1 depicts an implementation of a traffic preemption system as located at a traffic intersection.

Traffic preemption systems and methodology have been used extensively throughout the world for many years. As shown in FIG. 1, the portion of the traffic preemption system 100 that is located at a traffic intersection comprises an intersection control module 110 which is configured to communicate with an intersection preemption unit 130, which is commonly coupled with a traffic light support 120. The intersection control module 110 is configured to provide power and communicate with the intersection preemption unit 130 as well as other electronic devices such as a confirmation light 140 that may also comprise the traffic preemption system. Intersection preemption unit 130 is configured to receive radio, optical, or other signals transmitted from a vehicle preemption unit mounted to an emergency or other vehicle and communicate receipt of such signals to intersection control module 110 for control of the traffic light.

Most existing traffic preemption equipment utilizes a simple three wire interface. Thus, there are a high number of traffic intersections with three-conductor cables already installed that may benefit from additional equipment, such as for example, additional components such as a confirmation light 140 that may indicate to an emergency vehicle driver that the traffic preemption system has been activated. Such equipment, however, often has not yet been implemented due to the high cost of installing additional wires for power and communication.

Accordingly, the disclosure contained herein relates to the addition of power and/or communications to one or more wires intended to or that have historically only carried or been utilized for one purpose or the other. By combining both power and communications on the same wire(s), the number of wires and/or cables needed to install additional equipment may be reduced or eliminated.

Figure 2:
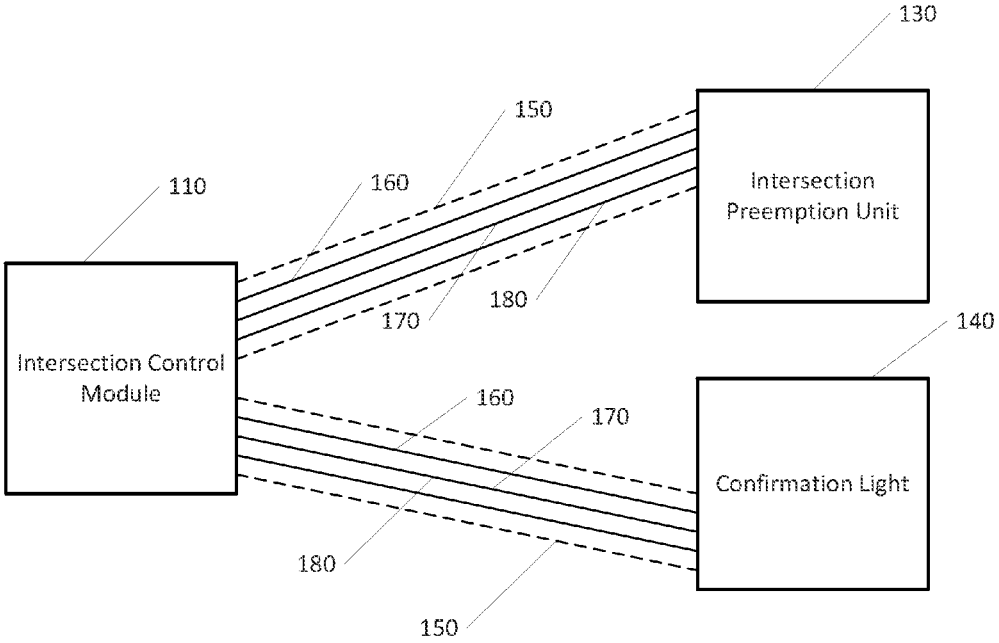
FIG. 2 Prior Art
FIG. 2 is a block diagram the prior art for powering and communicating with traffic preemption system components.

One implementation of the invention disclosed herein may be utilized with regards to traffic preemption equipment; however, this disclosure is not intended to be limited as such. As shown in FIG. 2, traditionally, traffic preemption equipment has historically utilized a simple three-wire cable interface 150 that includes power 160, ground 180 and signal 170 wires. To add additional equipment to the system that requires power and a way of communicating with one or more other system components, for example, a confirmation light 140, additional cable(s) beyond those used for the previously installed traffic preemption equipment 110, 130 are ordinarily required for power, ground and communication to power and control such additional equipment.

In one embodiment, a communications signal may be added to one or more wires that are used to provide power to system components. One of ordinary skill in the art would recognize that while this disclosure illustrates exemplary methods for doing so, any other such methodologies known in the art may also be employed to transmit a communications signal over a power wire.

Figure 3:
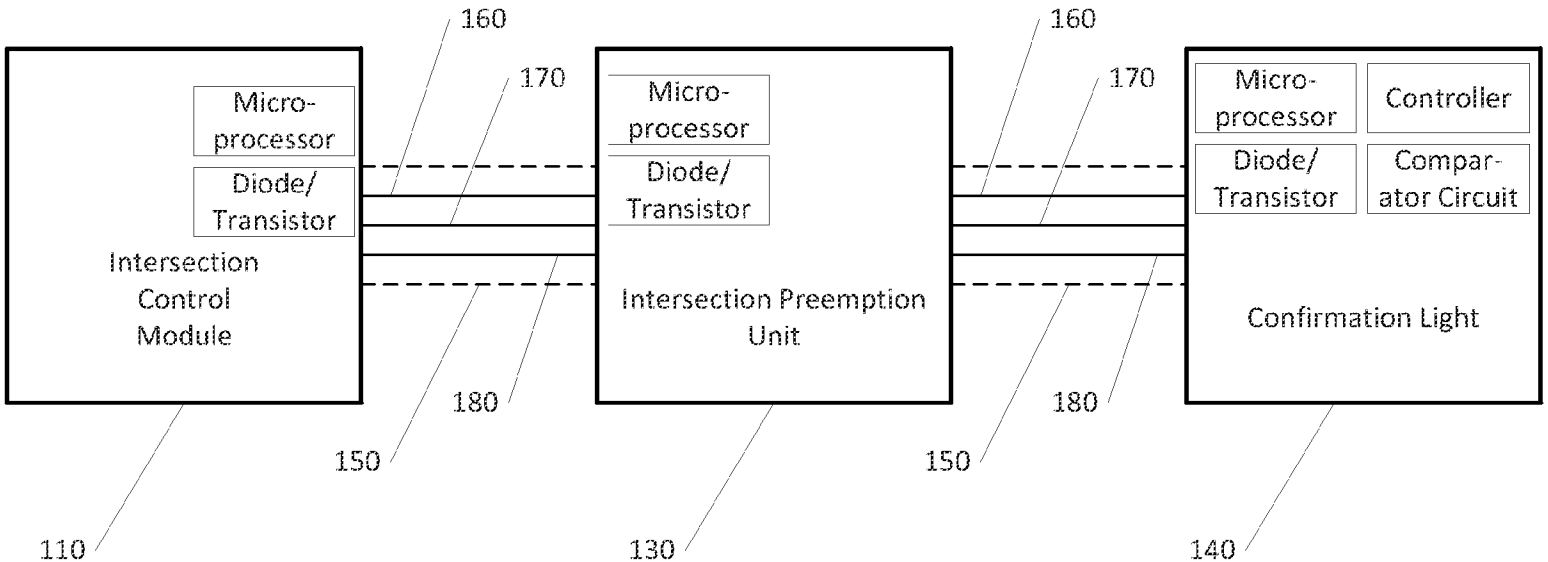
FIG. 3 is a block diagram of an implementation of a system for powering and communicating with traffic preemption system components.

As shown in FIG. 3, a digital or analog signal may be added to the power wire(s) 160, (positive, negative, ground or any combination of one or more of these three) by modulating such wire(s) 160 with one or more signals without negatively affecting or impacting the original purpose of the wire(s) 160 which is to provide power to system components, thereby eliminating the need for an additional cable 150 to be run from the intersection control module 110 to additional electronic equipment such as a confirmation light 140. The communication signal added to the power wire(s) 160 may also take any other possible form, such as but not limited to, wavelets, noise envelopes, or other communication forms known to those of ordinary skill in the art.

When adding a modulated communication waveform to the positive wire in the traffic preemption system's three-wire interface example, a small voltage drop or increase (for example, a 0.7V change) may be introduced on the positive wire coming from the power source located in the intersection control module 110. The voltage drop or increase may be applied in a digital format for a variety of purposes such as for example, to control confirmation lights 140 by turning the light on to indicate to the driver of an emergency vehicle that the traffic preemption system 100 has detected the vehicle's presence and that a change in the traffic signal is imminent. Power for electronic devices such as the confirmation lights 140 may then be shared with a preemption detector or other system components, thereby requiring no additional wires to control and power both components.

In some implementations, a controlled voltage drop on the positive wire may be produced by adding one or more diodes in series with the power wire 160 and placing a transistor across the one or more diodes. The transistor may controlled by a microprocessor or other suitable device used to add the digital control signal to the positive power wire 160. When the transistor is on and conducting, the diode is shorted out and no voltage drop is placed on the power wire. When the transistor is turned off and is non-conducting, the voltage drop of the diode is placed on the power wire 160.

A small voltage drop on the power wire 160 will not negatively impact the power traveling through the wire to power either the confirmation lights 140 or other equipment that may be connected to the power wire 160.

Recovery of the digital control signal sent via the power wire 160 at the remotely located equipment can be easily accomplished through the use of a comparator circuit which compares the voltage on the power wire when the transistor is both conducting and non-conducting. The recovered digital control signal can then be applied to a microprocessor or other suitable device for further processing, filtering and actual control of the confirmation lights 140 or other remotely located electronic equipment.

Using a similar modulation technique at the remotely located equipment, communication from the remotely located electronic equipment 140 back to the intersection control module 110 can be accomplished using the signal wire 170 of the three-wire interface cable 150 rather than the power wire. Thus, two-way communication between the intersection control module 110 and the remotely located electronic equipment 140 is possible using both of the methods described above. As such, additional equipment may be powered and controlled utilizing the standard three-wire cable 150 used by conventional traffic preemption equipment without the need for additional cabling.

New communications may also be superimposed on an existing communications channel. One of ordinary skill in the art would recognize that this may be accomplished through any variety of techniques, depending upon the existing communications method. In essence, new communications may be added outside of the bandwidth of an existing communications signal or at low enough levels within the current bandwidth so as to leave the original communications signal unaffected. For example, an additional signal may be multiplexed such that it is transmitted during "down time" when the original communications signal is not being transmitted or multiplexed so that the additional signal is in a format or frequency range that does not interfere with any existing communication signals. An example of such simultaneous use of a channel may be to superimpose a low level signal that does not interfere with the existing communications. A superimposed signal that is 20 dB below other signals, for example, on the channel may allow existing communications to remain unaffected while allowing signal detection and extraction of the additionally transmitted communication signals.

Figure 4:
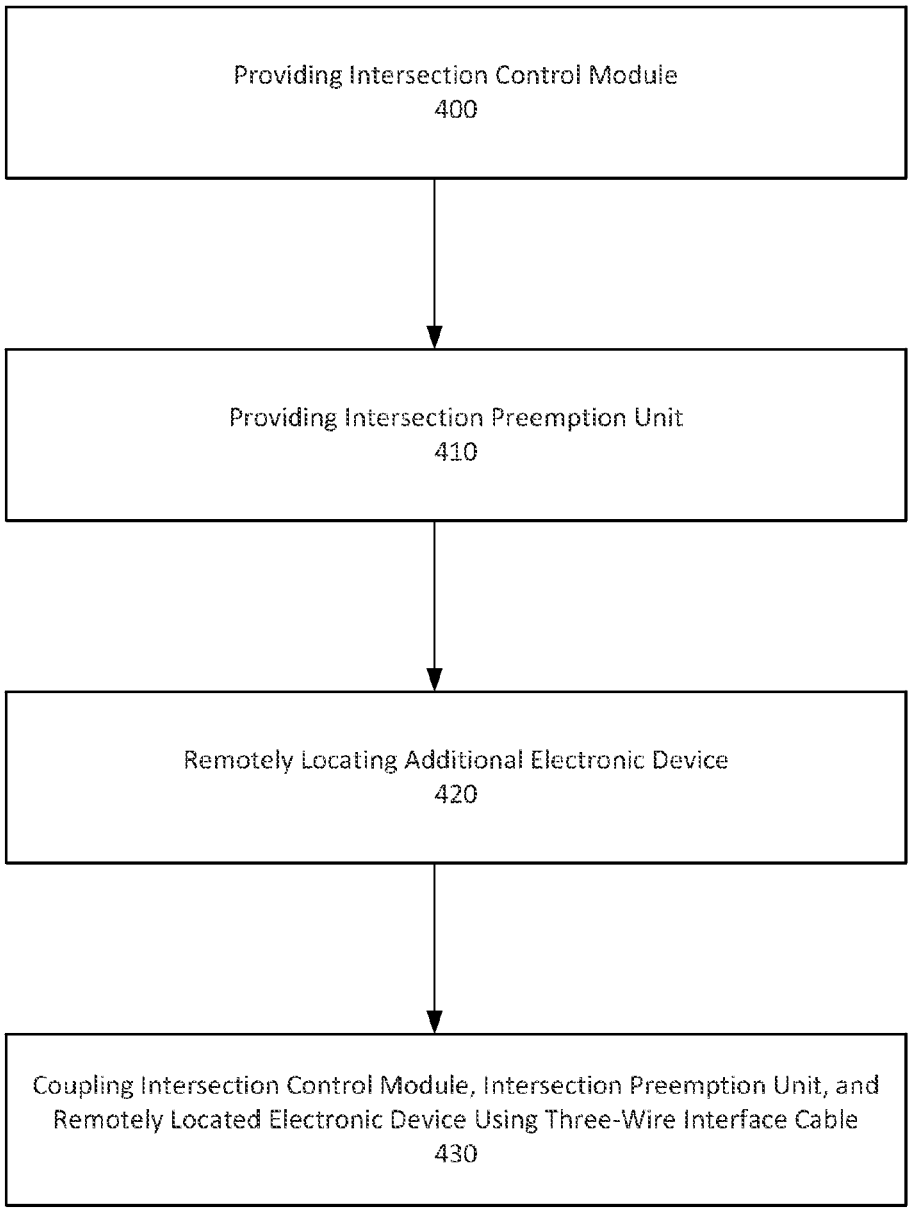
FIG. 4 is a flow chart of a first implementation of a method of constructing a traffic preemption system having a reduced number of cable interfaces required to power and control system components.

Referring now to FIG. 4, which provides a block diagram of an exemplary method of constructing a traffic preemption system, an intersection control module is provided 400. An intersection preemption unit that may be configured to receive a radio, optical, or other such signal that is transmitted by a vehicle-mounted vehicle preemption unit is also provided 410. An electronic device having a controller that is capable of detecting a voltage variation is remotely located 420 and the intersection controller, intersection preemption unit, and remotely located electronic device are coupled with a three-wire interface cable 430. As discussed above, the standard three-wire interface cable comprises a power wire that is configured to carry a modulated voltage level and share power among the intersection preemption unit and the remotely located electronic device as well as a ground wire and a communications wire that is configured to transmit a communications signal between the intersection preemption unit and the intersection controller. By constructing a traffic preemption system in such a manner as consistent with the above disclosure, the need for providing additional three-wire interface cables between the intersection control module and other additional electronic components, such as a confirmation light, are reduced or eliminated thereby providing advantages in overall system cost and labor required to install such additional components.

While this disclosure primarily discusses the disclosed implementations of the invention as related to the ability to power and communicate with additional traffic preemption equipment such as, but not limited to, confirmation lights, one of ordinary skill in the art will recognize that the systems and methods disclosed herein may also be used in conjunction with other types of equipment such as traffic measurement devices, cameras, communications equipment, pedestrian safety indicators and controls, and emergency equipment such as emergency phones.

In places where the description above refers to particular implementations of systems and methods for powering and communicating among the components of traffic preemption systems, it should be readily apparent that a number of modifications may be made without departing from the spirit thereof and that these implementations may be applied to other such systems and methods for traffic preemption system power and control.

The invention claimed is:

1. A traffic preemption system comprising:

an intersection control module;

an intersection preemption unit comprising a signal detector configured to receive a signal transmitted by a vehicle preemption unit mounted to a vehicle;

a remotely located electronic device to provide a confirmation output of receipt by said intersection preemption unit of said signal transmitted by said vehicle preemption unit, comprising a controller configured to detect a variation in voltage; and a cable coupling the intersection control module, the intersection preemption unit, and the remotely located electronic device, the cable comprising:

a power wire configured to carry a modulated voltage level to provide said variation in voltage, and share power among the intersection preemption unit and the remotely located electronic device;

a ground wire; and a communications wire configured to transmit a communications signal between the intersection preemption unit and the intersection control module to control traffic light signals according to a preemptive traffic light control procedure responsive to receipt by said intersection preemption unit of said signal transmitted by said vehicle preemption unit.

2. The system of claim 1, wherein the remotely located electronic device comprises a confirmation light configured to indicate receipt of the signal by the signal detector of the intersection preemption unit.

3. The system of claim 1, further comprising:

a diode coupled in series with the power wire; and a transistor located across the diode.

4. The system of claim 1, further comprising a microprocessor configured to create a digital control signal for transmission over the power wire.

5. The system of claim 4, wherein the confirmation light further comprises a confirmation light controller that is further configured to engage or disengage the confirmation light in response to a digital control signal transmitted over the power wire.

6. The system of claim 4, wherein the remotely located electronic device further comprises a microprocessor configured to process the digital control signal received via the power wire.

7. The system of claim 1, wherein the remotely located electronic device controller further comprises a comparator circuit configured to compare a voltage on the power wire at different points in time.

8. The system of claim 1, wherein the communications wire is further configured to convey a signal from the remotely located electronic device to the intersection control module.

9. The system of claim 8, wherein the signal is conveyed from the remotely located electronic device to the intersection control module using handshaking.

10. The system of claim 8, wherein the communications wire is further configured to convey a superimposed signal in addition to the communications signal transmitted between the intersection preemption unit and the intersection control module.

11. A method of constructing a traffic preemption system, the method comprising:

providing an intersection control module;

providing an intersection preemption unit comprising a signal detector configured to receive a signal transmitted by a vehicle preemption unit configured to mount to a vehicle;

remotely locating an electronic device to provide a confirmation output of receipt by said intersection preemption unit of said signal transmitted by said vehicle preemption unit, comprising a controller configured to detect a variation in voltage; and coupling the intersection control module, the intersection preemption unit, and the remotely located electronic device with a cable comprising:

a power wire configured to carry a modulated voltage level to provide said variation in voltage, and share power among the intersection preemption unit and the remotely located electronic device;

a ground wire; and a communications wire configured to transmit a communications signal between the intersection preemption unit and the intersection control module to control traffic light signals according to a preemptive traffic light control procedure responsive to receipt by said intersection preemption unit of said signal transmitted by said vehicle preemption unit.

12. The method of claim 11, wherein the remotely located electronic device comprises a confirmation light configured to indicate receipt of the signal by the signal detector of the intersection preemption unit.

13. The method of claim 11, further comprising:

coupling a diode in series with the power wire; and locating a transistor located across the diode.

14. The method of claim 11, further comprising coupling a microprocessor to the power wire, the microprocessor configured to create a digital control signal for transmission over the power wire.

15. The method of claim 14, further comprising providing a confirmation light controller that is further configured to engage or disengage the confirmation light in response to a digital control signal transmitted over the power wire.

16. The method of claim 14, further comprising providing a microprocessor configured to process the digital control signal received by the remotely located electronic device via the power wire.

17. The method of claim 11, further comprising providing a comparator circuit coupled to the controller of the remotely located electronic device, the comparator circuit configured to compare a voltage on the power wire at different points in time.

18. The method of claim 11, wherein the communications wire is further configured to convey a signal from the remotely located electronic device to the intersection control module.

19. The method of claim 18, wherein the remotely located electronic device and the intersection control module are configured to communicate using handshaking.

20. The method of claim 18, wherein the communications wire is further configured to convey a superimposed signal in addition to the communications signal transmitted between the intersection preemption unit and the intersection control module.

* * * * *